US007185630B2

(12) United States Patent
Takahashi et al.

(10) Patent No.: US 7,185,630 B2
(45) Date of Patent: Mar. 6, 2007

(54) AIR INTAKE DEVICE FOR ENGINE

(75) Inventors: Masanori Takahashi, Hamamatsu (JP); Katsumi Ochiai, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 68 days.

(21) Appl. No.: 10/714,759

(22) Filed: Nov. 17, 2003

(65) Prior Publication Data

US 2004/0094123 A1 May 20, 2004

(30) Foreign Application Priority Data

Nov. 15, 2002 (JP) ..... 2002-332479

(51) Int. Cl.
*F02D 41/00* (2006.01)
*F02D 1/00* (2006.01)

(52) U.S. Cl. ..... 123/361; 123/377; 123/399; 123/400

(58) Field of Classification Search ..... 123/361, 123/376, 377, 399, 400
See application file for complete search history.

(56) References Cited

U.S. PATENT DOCUMENTS 5,803,043 A * 9/1998 Bayron et al. ..... 123/335
5,823,835 A 10/1998 Takahashi et al.
5,875,745 A 3/1999 Watanabe et al.
5,941,205 A 8/1999 Hiraoka et al.
6,109,231 A 8/2000 Watanabe et al.
6,253,729 B1 7/2001 Suzuki et al.
6,298,815 B1 10/2001 Kashima et al.
6,497,214 B2 * 12/2002 Yagi ..... 123/399
6,536,409 B1 3/2003 Takahashi et al.
6,699,085 B2 * 3/2004 Hattori ..... 440/87
6,733,350 B2 * 5/2004 Iida et al. ..... 440/84
2005/0056012 A1 * 3/2005 Wild et al. ..... 60/602

* cited by examiner

*Primary Examiner*—John T. Kwon
(74) *Attorney, Agent, or Firm*—Knobbe, Martens, Olson & Bear, LLP

(57) ABSTRACT

An engine includes a throttling device configured for both mechanical and electrical control. For example, the throttling device can include a throttle cable connection assembly configured to allow a throttle valve shaft of the throttling device to be controlled by movement of throttle cables and an electronic control section configured to allow the throttle valve to be moved by an electronic actuator. The throttling device can include a connector member configured to selectively engage and disengage the mechanical control section from the throttle valve shaft so as to allow the electrical control section to adjust the throttle valve shaft without resistance from the mechanical control section. The engine can also include a switch for indicating to an electronic controller whether or not the mechanical control section is engaged with a throttle valve shaft.

12 Claims, 11 Drawing Sheets

AIR INTAKE DEVICE FOR ENGINE

PRIORITY INFORMATION

This application is based on and claims priority to Japanese Patent Application No. 2002-332479, filed Nov. 15, 2002, the entire contents of which is hereby expressly incorporated by reference.

BACKGROUND

1. Field of the Inventions

The present embodiments are directed to an induction system for an engine and more particularly to induction systems that can be controlled mechanically or electronically.

2. Description of the Related Art

As is known in the art, the configuration of an induction system of an engine is determinative of the performance of the engine. By appropriately configuring the induction system and designing its volume, the length of the intake runners, and the control of movement of air therethrough, can be optimized.

Recently, electronic throttle control systems have become more widely available. Such systems utilize sensors and electronic controllers to control a throttle valve, intake system geometry, or intake valve timing to control a flow of air through the induction system. In order to provide transparent operation of such a system, the relevant sensors are sampled at a high frequency and the electronic actuators are operated at high frequency duty cycles so that the power output of the engine accurately tracks a power request from the operator of the engine, for example, determined by the position of what is commonly referred to as a "throttle lever".

Such systems require more complex mapping and higher speed processors to provide such functionality. Thus, such engines are provided with more expensive engine computers than those engines in which the induction air flow is controlled solely by a mechanically actuated throttle valve.

SUMMARY OF THE INVENTION

An aspect of at least one of the inventions as disclosed herein includes the realization that certain induction system components can be used on an engine, whether or not the engine utilizes electronic control of air flow through the induction system. For example, a throttle body can be provided with a throttle cable connection configured to allow a throttle valve of the throttle body to be controlled mechanically by manipulation of a throttle lever, as well as an electric motor configured to operate the throttle valve through its full range of motion in accordance with the output of a power output request sensor, such as, for example, a "throttle lever" position sensor. As such, the same throttle body can be used on engines sold for use with watercraft which do not include an electronic "throttle lever" as well as watercraft that do include such an electronic throttle lever. As such, a line of engines can be manufactured less expensively by utilizing the same throttle body for both types of engines.

Thus, in accordance with at least one of the embodiments disclosed herein, A throttle body for an engine comprises an air passage, a throttle shaft extending through the air passage, and a throttle valve rotatably mounted to the shaft and positioned within the air passage. A mechanical control interface member is mounted to the shaft without a direct rotatable connection to the shaft and a retainer configured to retain the mechanical control interface member in a position relative to the shaft. A connector member is releaseably engageable with the mechanical control interface member and rotatably connected to the shaft.

In accordance with at least one of the embodiments disclosed herein, an engine comprises an engine body defining a combustion chamber therein, an induction system configured to guide air to the combustion chamber, and an air metering device configured to meter an amount of air flowing through the induction system toward the engine body. The air metering device includes a mechanical interface connectable to a mechanical power output request device and an electronic actuator capable of adjusting the air metering device between its maximum and minimum operating conditions. A switch is configured to provide an indication whether or not the mechanical interface is operatively connected to the air metering device.

In accordance with at least one of the embodiments disclosed herein, an engine comprises an engine body defining a combustion chamber therein, an induction system configured to guide air to the combustion chamber, and an air metering device configured to meter an amount of air flowing through the induction system toward the engine body. The air metering device includes a mechanical interface and an electronic actuator, each of which are configured to adjust the air metering device between its maximum and minimum operating conditions. The engine also includes means for selectively disengaging the mechanical interface and the electronic actuator from the air metering device.

DETAILED DESCRIPTION OF THE PREFERRED EMBODIMENT

An improved induction system for an engine is disclosed herein. The engine includes an induction system that can be conveniently switched between a mechanical and an electrical operating mode. Although the present induction system is illustrated and described in the context of an outboard motor, certain aspects of the present inventions can be used with engines of other types of vehicles, as well as with other types of prime movers.

Figure 1:
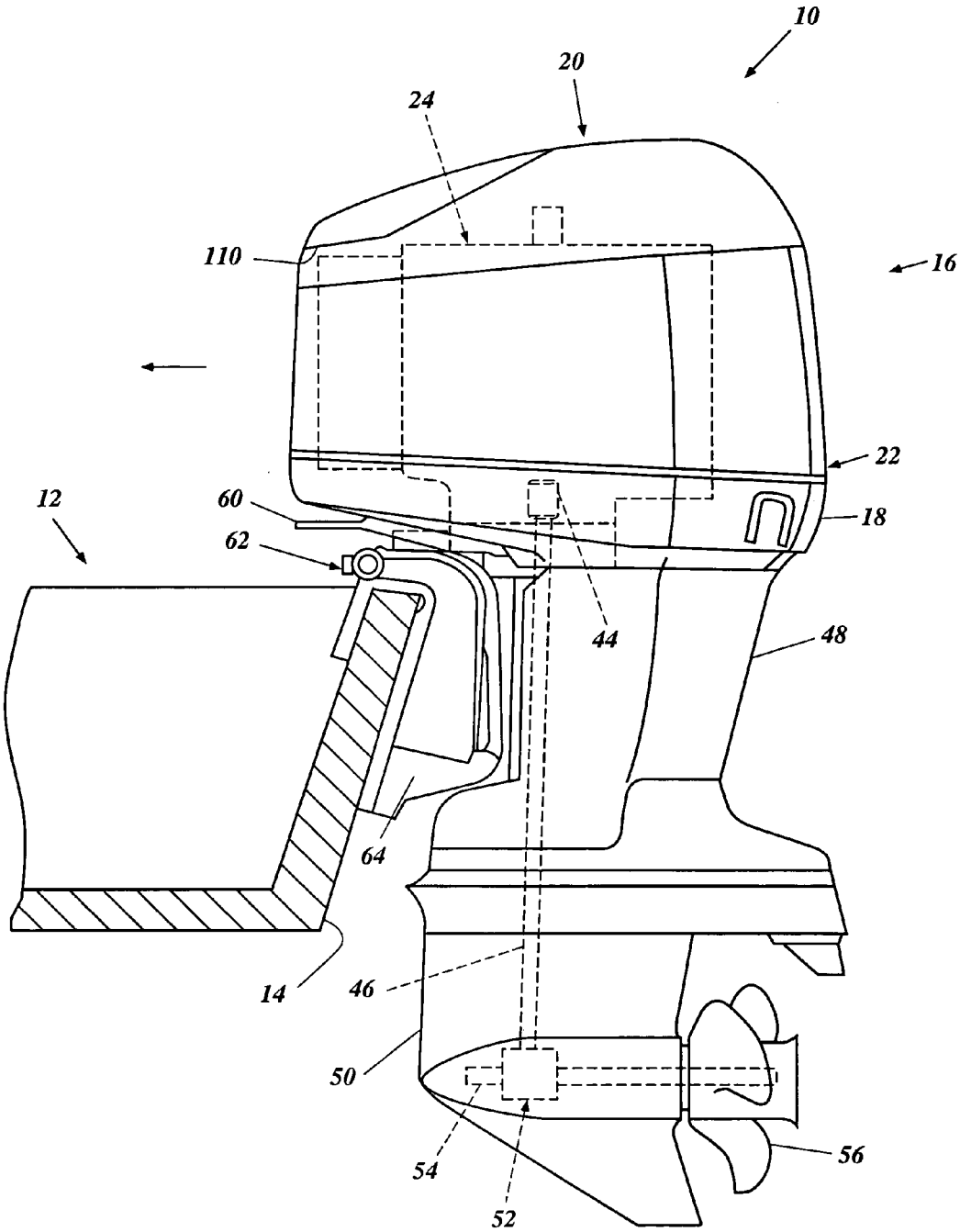
FIG. 1 is a side elevational view of an outboard motor which can embody an engine (shown in phantom) that is configured in accordance with one of the embodiments disclosed herein, the outboard motor being mounted to the transom of a watercraft (shown partially)

With reference to FIG. 1, an outboard motor constructed in accordance with one embodiment, is identified generally by the reference numeral 10. The outboard motor 10 is shown as being attached to an associated watercraft hull, indicated generally by the reference numeral 12, and shown partially in cross-section. The outboard motor 10 is shown attached to a transom 14 of the hull 12 in a manner which is described below in greater detail.

The outboard motor 10 is comprised of a powerhead, indicated generally by the reference numeral 16. The powerhead 16 includes a lower tray portion 18 which may be formed from aluminum or an aluminum alloy, and a main cowling portion 20 that is detachably connected to the tray 18 in a known manner. The main cowling portion 20 is formed from a suitable material, such as molded fiberglass, reinforced resin, or the like. The main cowling portion 20 has a lower peripheral edge 22 that is held in a sealing engagement with a tray portion 18 by a suitable latching device (not shown).

The protective cowling 20 encircles an internal combustion engine, indicated generally by the reference numeral 24, and which has a construction that is described in greater detail below. In the illustrated embodiment, however, the engine 24 is a V-6, 4-stroke engine. Those skilled in the art, however, readily appreciate that the present induction system can be used with any of a variety of engines having other numbers of cylinders, and/or other cylinder arrangements.

Figure 2:
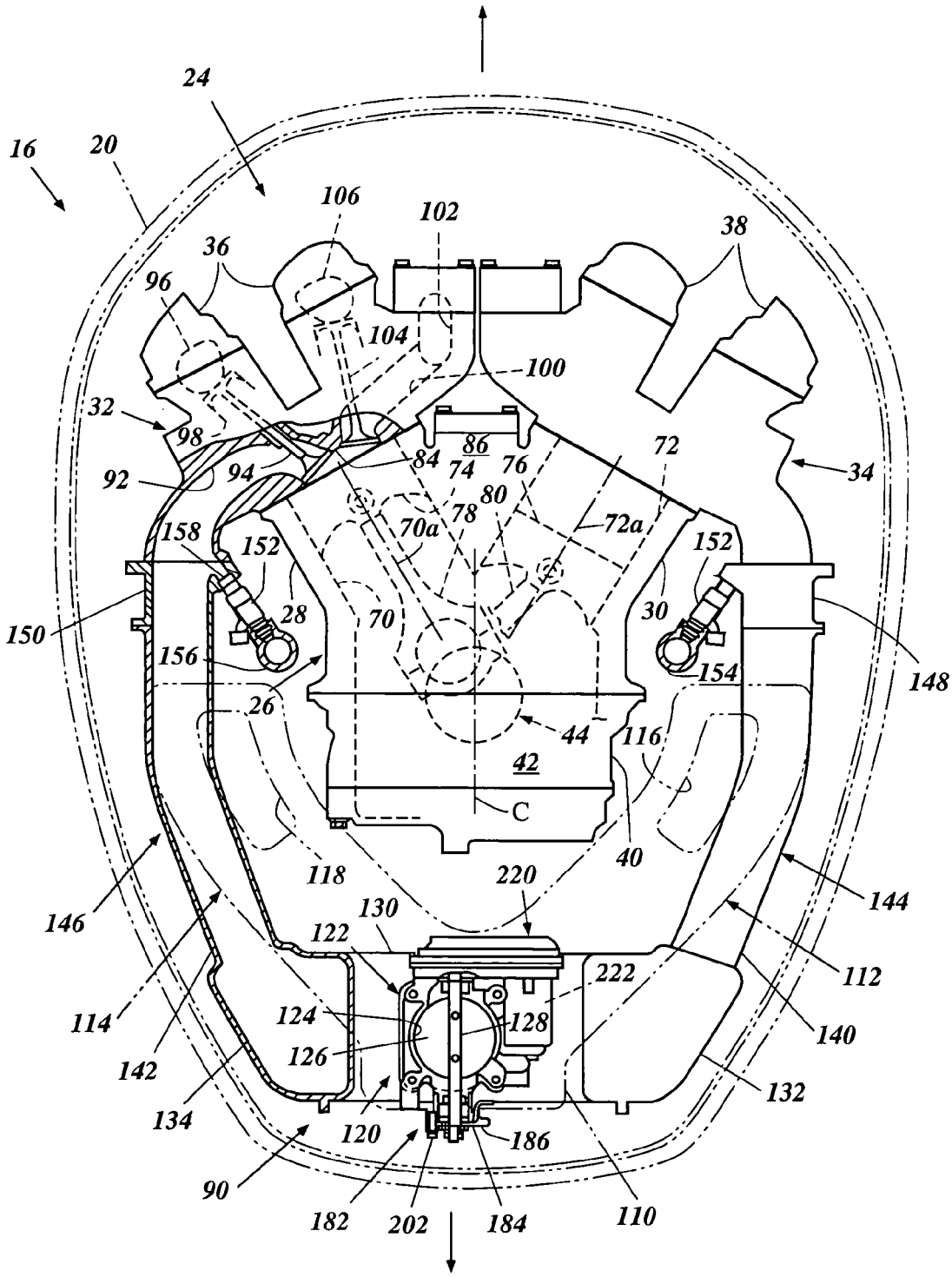
FIG. 2 is a top plan and partial cross-sectional view along line 2-2 of FIG. 1, with an upper cowling of the outboard motor shown in phantom.

As shown in FIG. 2, the engine 24 includes a cylinder block 26 which includes a pair of cylinder banks 28 and 30 arranged in a V-type configuration. The cylinder banks 28, 30 are closed at their rear ends (i.e., the end farthest from the transom 14 of the boat) by cylinder head assemblies 32, 34 in a manner described below in greater detail. Camcovers 36, 38 are affixed to the cylinder head assemblies 32, 34, respectively, and enclose respective cam chambers in which valve actuating mechanisms are contained. In the illustrated embodiment, these valve actuating mechanisms are comprised of twin overhead camshafts for each cylinder head assembly 32, 34, also described in greater detail below.

A crankcase member 40 is affixed to the end of the cylinder block 26 opposite the cylinder head assemblies 32, 34. As such, the crankcase member defines a crankcase chamber 42 in which a crankshaft 44 is rotatably journaled. As is typical with outboard motor practice, the engine 24 is mounted in the powerhead 16 so that the crankshaft 44 rotates about a generally vertically extending axis. This facilitates coupling to a drive shaft 46 (FIG. 1). A center plane C is illustrated as extending though a central plane of the engine 24, extending along the forward-rearward direction.

As shown in FIG. 1, the drive shaft 46 extends into and is journaled within a drive shaft housing, indicated generally by the reference numeral 48, and which is enclosed at its upper end by the tray 18.

The drive shaft 46 also extends into a lower unit 50, wherein it drives a conventional bevel gear, forward, neutral, and reverse transmission, indicated generally by the reference numeral 52, which is shown schematically. The transmission 52 is shown in a schematic fashion because its construction per se forms no part of the inventions herein. Therefore, any known type of transmission may be employed.

The transmission 52 drives a propeller shaft 54 which is journaled within the lower unit 50 in a known manner. A hub of a propeller 56 is coupled to the propeller shaft 54 for providing a propulsive force to the watercraft hull 12 in a manner well known in the art.

A steering shaft (not shown) is attached to the outer housing casing 48 by upper and lower bracket assemblies (not shown) in a known manner. The steering shaft is supported for steering movement within a swivel bracket (not shown) so as to pivot about a vertical steering axis. The steering axis is juxtaposed to and slightly forward of the drive shaft axis. A tiller or steering arm 60 is affixed to the upper end of the steering shaft for steering the outboard motor 10 through an arc.

A swivel bracket is connected by a pivot pin assembly 62 to a clamping bracket 64. The pivot pin assembly 62 permits tilt and trim movement of the swivel bracket and the outboard motor 10 relative to the transom 14 of the hull 12.

A hydraulic tilt and trim mechanism (not shown) can be pivotally connected between the swivel bracket and the clamping bracket 64 for effecting hydraulic tilt and trim movement of the outboard motor 10, and for permitting the outboard motor 10 to pop up when an underwater obstacle is struck. As is well known, these types of hydraulic mechanisms permit the outboard motor 10 to return to its previous trim adjusted position once such an underwater obstacle is cleared.

With reference again to FIG. 2, the construction of the engine 24 is described in greater detail. As has been noted, the engine 24 is of the V-type and, accordingly, the cylinder block 26 is formed with the pair of angularly related cylinder banks 28, 30. Each of the cylinder banks 28, 30 are formed with a plurality of horizontally extending cylinder bores 70, 72, defining cylinder axes 70*a*, 72*a*, respectively. The cylinder bores 70, 72 may be formed with thin liners that are either cast or otherwise secured in place within the cylinder banks 28, 30. Alternatively, the cylinder bores 70, 72 may be formed directly in the base material of the cylinder banks 28, 30. If a light alloy casting is employed for the cylinder banks 28, 30, such liners can be used.

In the illustrated embodiment, the cylinder banks 28, 30 each include three cylinder bores 70, 72. Since the engine 24 is a V-type engine, the cylinder bores 70, 72 in each cylinder bank preferably are staggered with respect to one another.

With continued reference to FIG. 2, pistons 74, 76 are supported for reciprocation in the cylinder bores 70, 72, respectively. Piston pins connect the pistons 74, 76 to connecting rods 78, 80. The connecting rods 78, 80 as is typical in V-type engine practice, may be journaled in a side by side relationship on adjacent throws of the crankshaft. That is, pairs of cylinders 70, 72, one from each of the cylinder banks 28, 30, may have the big ends of their connecting rods 78, 80 journaled in a side by side relationship on adjacent crankshaft throws. This is one reason why the cylinder bores 78, 80 of the cylinder banks 28, 30 are staggered relative to each other. In the illustrated embodiment, however, separate throws are provided for the cylinders of each cylinder bank 28, 30. The throw pairs are nevertheless disposed between main bearings (not shown) of the crankshaft 44 to maintain a compact construction.

The cylinder head assemblies 32, 34 are provided with individual recesses 84 which cooperate with the respective cylinder bores 70, 72 and heads of the pistons 74, 76 to form combustion chambers. These recesses 80 are surrounded by a lower cylinder head surface that is generally planar and held in sealing engagement with either the cylinder banks 28, 30 or with cylinder head gaskets (not shown) interposed therebetween, in a known manner. These planar surfaces of the cylinder head assemblies 32, 34 may partially override the cylinder bores 70, 72 to provide a squish area, if desired. The cylinder head assemblies 32, 34 are affixed in any suitable manner to the cylinder banks 28, 30.

Because of the angular inclination between by the cylinder banks 28, 30, as is typical with V-type engine practice, a valley 86 is formed between the cylinder head assemblies 32, 34.

An induction system for the engine, indicated generally by the reference numeral 90, is configured to guide induction air into intake ports 92 defined in the cylinder head assemblies 32, 34 for combustion in the combustion chambers therein. The construction of the induction system 90 is described in greater detail below.

Poppet-type intake valves 94 are slidably supported in the cylinder head assemblies 32, 34 in a known manner (the valves 92 in the cylinder head assembly 34 are not shown). The valves 94 have their head portions engageable with valve seats disposed on an inner end of the intake ports 92 so as to control the flow of induction air into the combustion chambers through the ports 92. The intake valves 94 are biased toward their closed position by coil compression springs (not shown). The valves 94 are operated by intake camshafts 96 which are journaled in the cylinder head assemblies 32, 34. The intake camshafts 96 have cam lobes which operate the valves 92 through thimble tappets 98.

The cylinder head assemblies 32, 34 also include exhaust ports 100 configured to guide exhaust gases from the combustion chambers to exhaust gas discharge passages 102 (the exhaust ports of the cylinder head assembly 34 are not shown). Exhaust valves 104 are also supported for reciprocation, similarly to the intake valves 94, in the cylinder head assemblies 32, 34 to cooperate with exhaust valve seats disposed in the combustion chambers to open and close the exhaust ports 100 and thereby control the flow of exhaust gases from the combustion chambers, through the ports 100, and into the exhaust discharge passages 102. Exhaust camshafts 106 drive the exhaust valves 104 to control the opening and closing timing thereof.

A camshaft drive train (not shown) drives the camshafts 96, 106 in phase with the rotation of the crankshaft 44. In a 4-stroke engine, the camshafts 96, 106 are driven at one-half the rotational speed of the crankshaft 44.

The exhaust discharge path 102 leads to an exhaust system (not shown) which discharges the exhaust gases preferably below a level of the water in which the outboard motor 10 operates, in a known manner.

With reference again to FIG. 1, as is typical with outboard motor practice, the upper cowling 20 includes an air inlet 109 through which ambient atmospheric air enters the powerhead 16. The air inlet 109 desirably is configured to permit copious amounts of air to flow into the interior of the protective cowling, while at the same precluding or substantially precluding water intrusion. Any of the known inlet-type devices can be utilized for this purpose, and therefore, the cowling air inlet 109 is shown only schematically.

Figure 3:
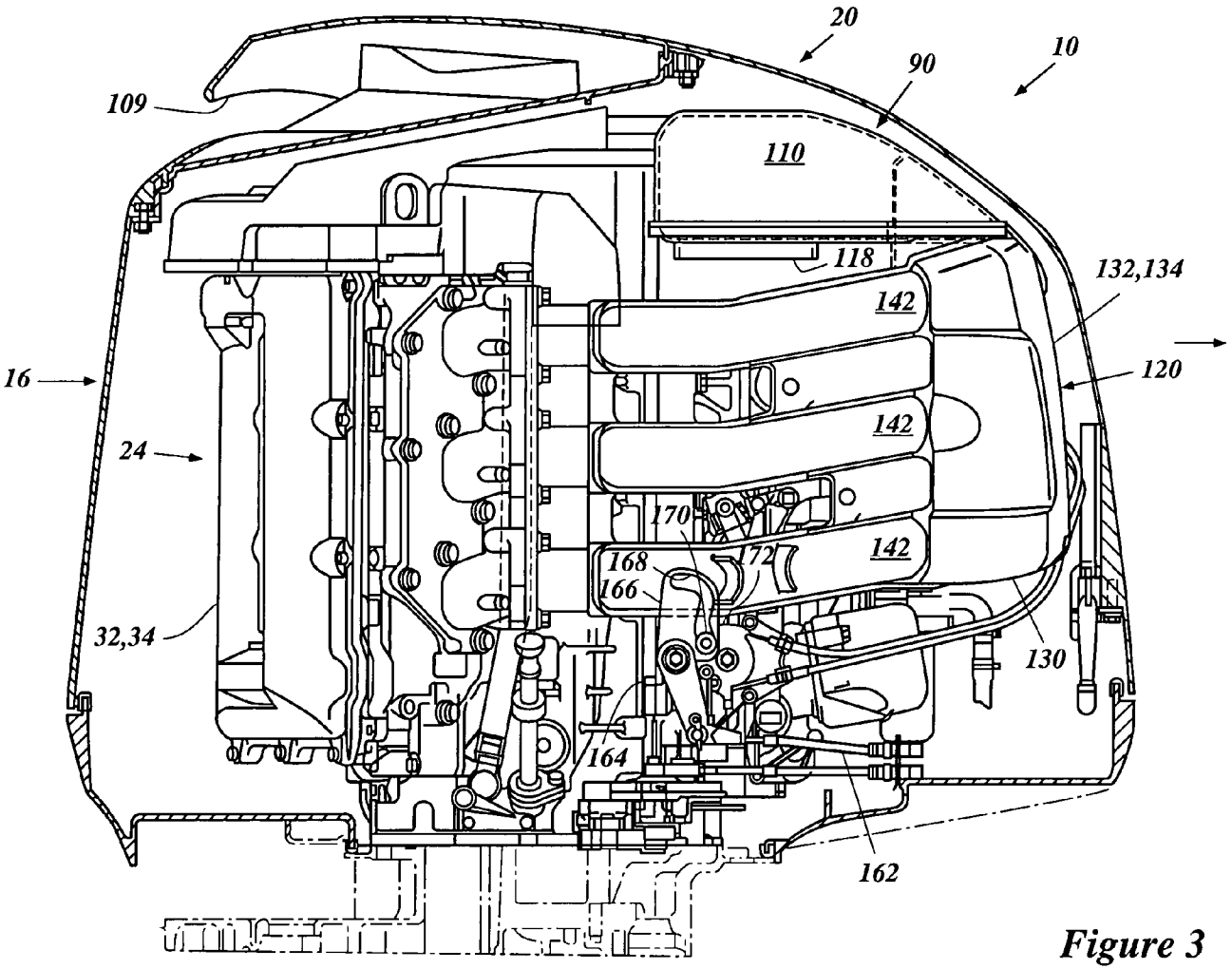
FIG. 3 is an enlarged starboard side elevational and partial sectional view of the engine illustrated in FIG. 2.

With reference to FIG. 3, the induction system 90 includes a first plenum chamber 110 configured to receive induction air from the interior of the powerhead 16. With reference to FIG. 2, the plenum chamber 110 is generally U-shaped, having port and starboard arms 112, 114 extending rearwardly within the powerhead 16. At the rearward ends thereof, the arms 112, 114 include downwardly facing inlets 116, 118 configured to allow air from within the powerhead 16 to flow upwardly into the plenum chamber 110.

An outlet 111 (FIG. 4) of the plenum chamber 110 connects to the inlet of a throttling device 120. As shown in FIG. 2, the throttling device 120 includes a throttle body 122 defining an induction passage 124 through which all of the induction air passes. A butterfly valve 126 is mounted on a throttle valve shaft 128 which extends through the induction passage 124. As such, the throttle valve 126 can be used to meter an amount of air flowing through the induction passage 124 and thus control an amount of air flowing through the induction system into the induction ports 92. The throttling device 120 can include a fuel supply system and thus operate as a carburetor. In the illustrated embodiment, however, the throttling device 120 is configured to operate in conjunction with a fuel injection system, described in greater detail below.

An outlet of the throttling device 120 is connected to an inlet of a surge tank 130 which extends generally laterally beneath the throttling device 120. At its port and starboard ends, the surge tank 130 branches into port and starboard surge tank portions 132, 134. As such, the surge tank 130 and the port and starboard surge tank portions 132, 134 form a generally U-shaped surge tank, when the left and right surge tank portions 132, 134 define upwardly extending arms of the surge tank 130.

Each of the port and starboard surge tank portions 132, 134 include a plurality of outlets 140, 142. In the illustrated embodiment, there is one outlet 140, 142 for each of the cylinder bores 70, 72. Thus, because the illustrated engine 24 is a 6-cylinder engine, there are three port side outlets 140 and three starboard side outlets 142. The outlets 140, 142 branch from the common surge tank defined by the port and starboard surge tank portions 132, 134, respectively, thereby forming intake runners 144, 146 extending from the outlets 140, 142, respectively, to the intake ports 92.

In the illustrated embodiment, each of the intake runners 144, 146 is connected to the intake ports 92 with connector members 148, 150, respectively.

The engine 24 also includes a fuel system configured to mix fuel with the air from the induction system 90 for combustion in the combustion chambers. In the illustrated embodiment, the fuel system is a port-type fuel injection system. As such, the fuel injection system includes a fuel injector 152 mounted to each of the connector members 148, 150. Thus, there is one fuel injector 152 for each of the cylinders 78, 72. However, other types of fuel injection systems can be used.

The fuel injectors 152 are provided with fuel from a fuel rail or conduit. In the illustrated embodiment, the fuel injectors 152 on the port side of the engine 24 are fed fuel from a port side fuel rail 154, and the fuel injectors 152 on the starboard side are fed with fuel from a starboard side fuel rail 156.

A suitable fuel supply system can be provided for supplying the fuel rails 154, 156 with fuel. Such fuel systems are well known in the art and they can be considered to be conventional. Thus, a further description of the fuel delivery system is not necessary for one of ordinary skill in the art to practice the invention.

Each of the fuel injectors 152 include an outlet nozzle 158 configured to discharge fuel therefrom in a spray or mist form. The discharge nozzles are mounted in an aperture provided in each of the connector members 148, 150. Additionally, the fuel injector nozzles 158 are oriented so as to spray fuel generally in the direction of air flowing through the intake runners 144, 146. Hence, the fuel spray from the injectors 152 can easily mix with the air flowing into the combustion chambers so as to provide a good mixture distribution.

The engine 24 also includes an ignition system (not shown). The ignition system can include one or a plurality of spark plugs for each of the combustion chambers. Such spark plugs can be mounted in the cylinder head assemblies 32, 34 such that their electrodes extend into the recesses 84. Such spark plugs can be fired by a suitable ignition system, in a known manner.

During operation, induction air enters the inlet 110 of the cowling 20 (FIG. 3). The air within the cowling 20 enters the inlets 116, 118 in the induction system 90 (FIG. 2). Through the inlets 116, 118, the induction air enters the first plenum chamber 110. As such, the induction air is quieted and smoothed before passing through the throttling device 120.

Through the manipulation of the butterfly valve 126 of the throttling device 120, the air flowing through the induction system 90 is metered in accordance with a desired power output of the engine 24. Downstream from the throttling device 120, the induction air enters the surge tank 130 at which the air is divided into two main flows into the port and starboard surge tanks 132, 134.

Air from the port and starboard surge tanks 132, 134 is divided into individual air flows, exiting the tanks 132, 134 through the outlets 140, 142. As the air flows through the runners 144, 146, the fuel injectors 152 spray fuel into the intake ports 92 at a desired amount and timing in accordance with a desired control strategy.

The air from the induction system 90 and the fuel from the fuel injectors 152 mix in and around the induction ports 92 and enter the combustion chambers of the engine 24 through the intake valves 94. The timing of opening, closing, and opening amount are controlled by the intake camshaft 96. Although not illustrated, the engine 24 can include a variable valve timing system which allows at least one of the intake valve opening timing, closing timing and opening amount to be adjusted.

After an air fuel charge from the intake port 92 enters the combustion chamber, the air fuel charge is compressed during the compression stroke of the pistons 74, 76. At a desired timing, the spark plugs ignite the compressed air fuel charge, thereby driving the piston through the power stroke. After the power stroke, the exhaust valves 104 open and allow the burnt exhaust gases to exit the combustion chambers through the exhaust ports 100 and into the exhaust conduits 102.

As noted above, the fuel injectors 152 and spark plugs can be controlled in accordance with any appropriate control strategy. For example, an electronic control unit (not shown) can control the timing and amount of fuel injection through the fuel injectors 152 and the timing and duration of spark provided by the spark plugs. If the engine 24 includes a variable valve timing system, such an electronic control unit can also provide control input for such a variable valve system. Additionally, such an electronic control system can provide control signals control signals for the throttle valve 126 where an electronic controller is provided for adjusting the position of the throttle valve 126. For example, the electronic control unit can provide control signals for controlling an idle speed of the engine 24. As such, the electronic control unit can be configured to send signals to an electronic controller for the throttle valve 126 for adjusting the position of the throttle valve 126 to achieve a desired idle speed.

Similarly, such an electronic control unit can adjust the position of the throttle valve 126 to provide a cruise control function. In another alternative, the electronic control unit can be configured to receive an input signal from an operator of the outboard motor 10 and electronically control all movement of the throttle valve 126, without regard to any mechanical input for the movement of the throttle valve 126.

Figure 4:
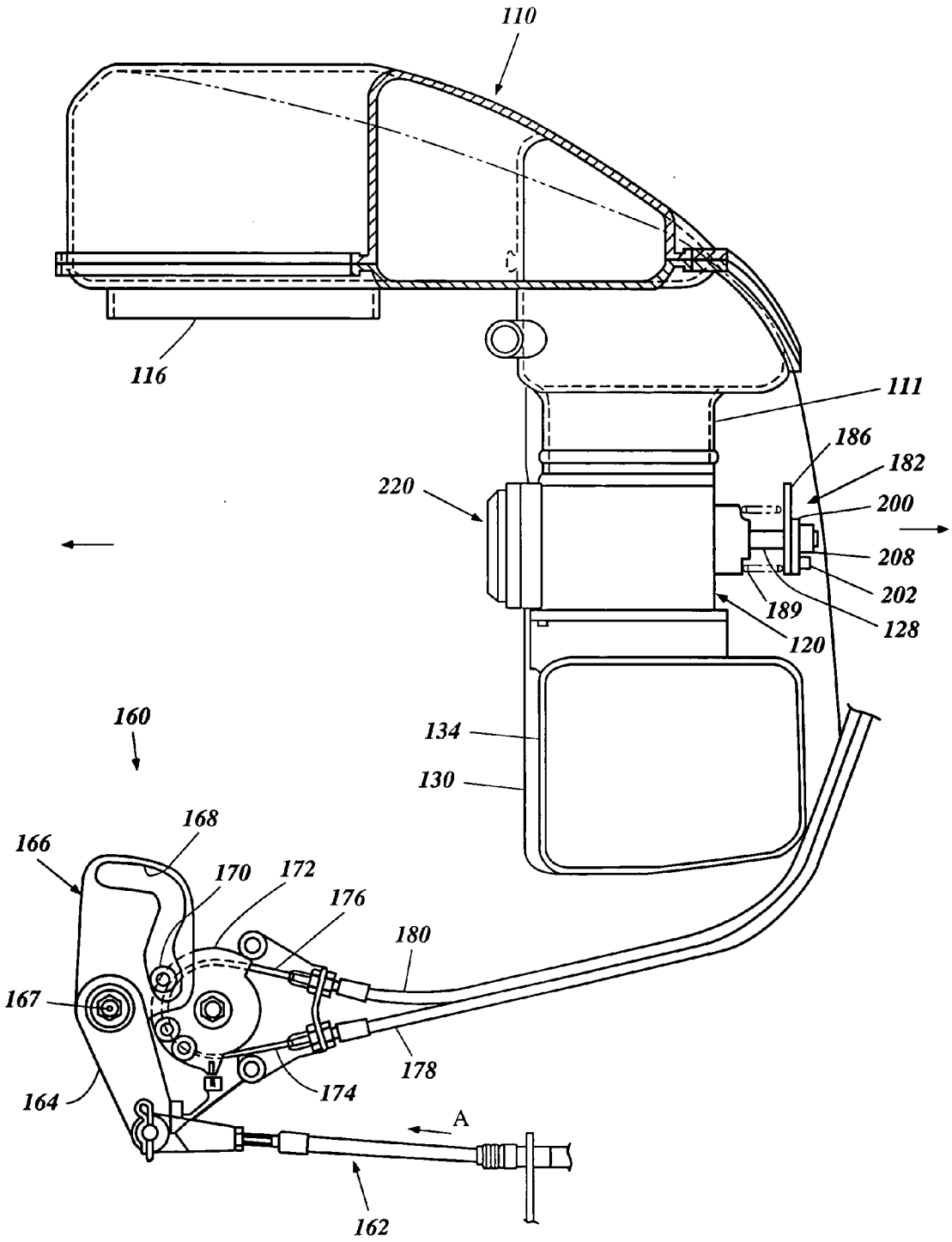
FIG. 4 is a starboard side elevational and partial sectional view of a portion of the induction system included on the engine illustrated in FIGS. 2 and 3.

With reference to FIGS. 3 and 4, the illustrated outboard motor 10 includes a mechanical throttle control system 160 configured to receive throttle control or power output control inputs from an operator of the outboard motor 10 and to generate a corresponding throttle control movement for controlling the position of the throttle valve 126. The system 160 includes an input assembly 162 configured to receive input movements from a throttle control module (not shown) disposed in the hull of the watercraft 12. For example, the watercraft 12 can include a conventional throttle control lever which allows a user to control a position of the transmission 52 as well as a position of the throttle valve 126. FIG. 4 illustrates an idle position of the input module 162. When the operator operates the throttle control lever, the input section 162 moves in the direction of arrow A.

The input module 162 is connected to an input lever member 164 which, in turn, is connected to a cam plate 166. The cam plate 166 is configured to provide a non-linear controlled response to input from the control module 162. The cam plate 166 includes a groove 168 in which a follower 170 travels.

The follower 170 is fixed to a throttle cable control pulley 172. The throttle cable control pulley 172 is connected to a throttle valve opening cable 174 and a throttle valve closing cable 176. As is common in the art of cable actuators, the cables 174, 176 extend through housings 178, 180.

As the throttle input module 162 is moved in the direction of arrow A, the camplate 166 rotates about the rotational axis 167. As the camplate 166 rotates, the follower 170 is guided along the groove 168. The shape of the groove 168 is configured to provide a non-linear response to the movements of the input module 162. In particular, the groove 168 is configured to move the throttle valve 126 so as to provide a power output that is more proportional to the movement of the throttle lever in the watercraft 12.

As the follower 170 follows the groove 168, the pulley 172 is rotated. In particular, as the input module 162 is moved in the direction of arrow A, the follower 170 causes the pulley 172 to rotate clockwise, as viewed in FIG. 4. The clockwise movement of the pulley 172 causes the throttle opening cable 174 to be pulled toward the pulley 172. When the input module 162 is moved in the direction opposite the arrow A, the throttle closing cable 176 is pulled toward the pulley 172, and the throttle opening cable 174 is allowed to retract into the housing 178. The cables 174, 176 are connected to the throttling device 120, as described below in greater detail.

Figure 5:
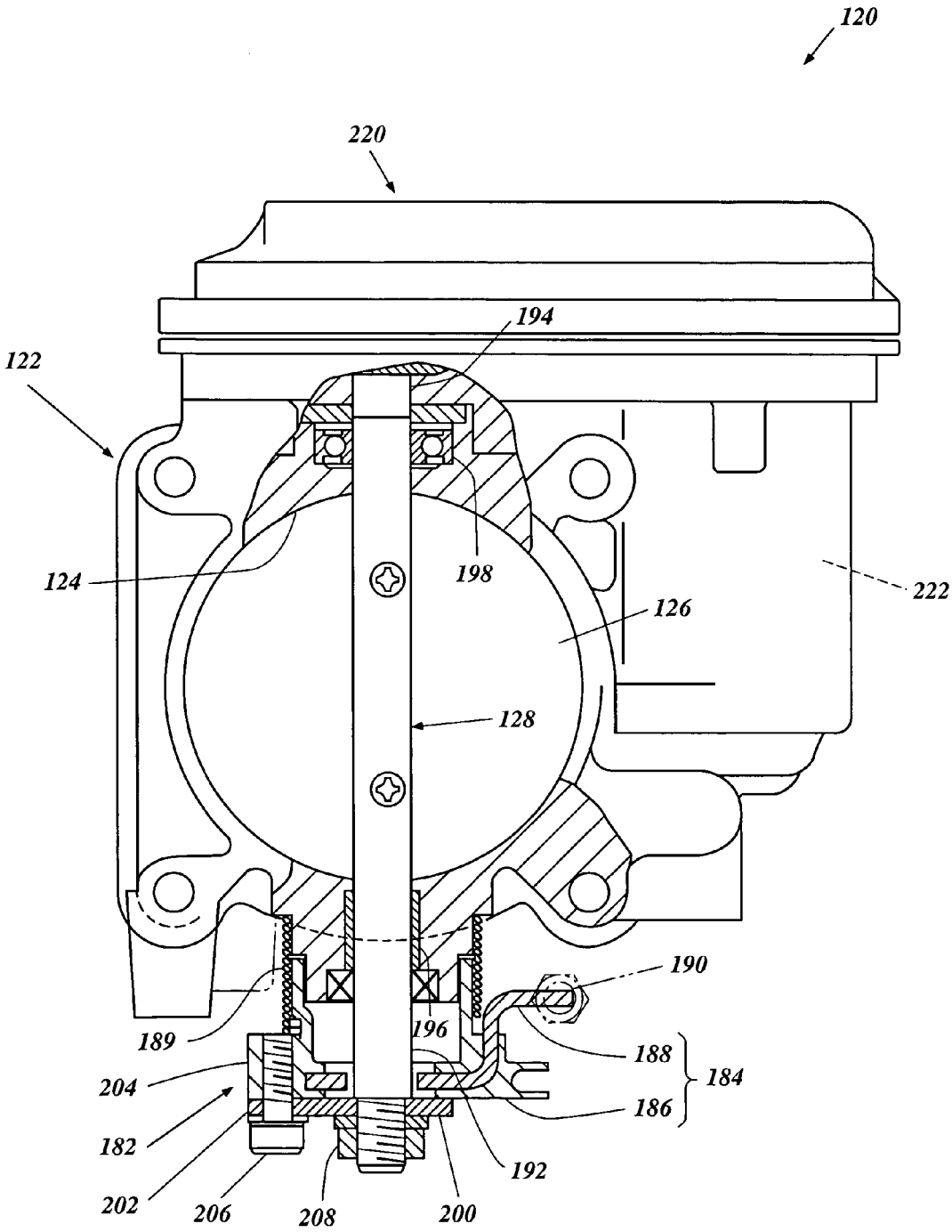
FIG. 5 is a top plan view of a throttling device included in the induction system illustrated in FIG. 4.

With reference to FIG. 5, the throttling device 120 includes a mechanical control section 182 configured to accept inputs from the cables 174, 176 for controlling the movement of the throttle valve 126. The mechanical control section 182 includes a throttle cable pulley assembly 184 configured to be connected with the cables 174, 176.

Figure 6:
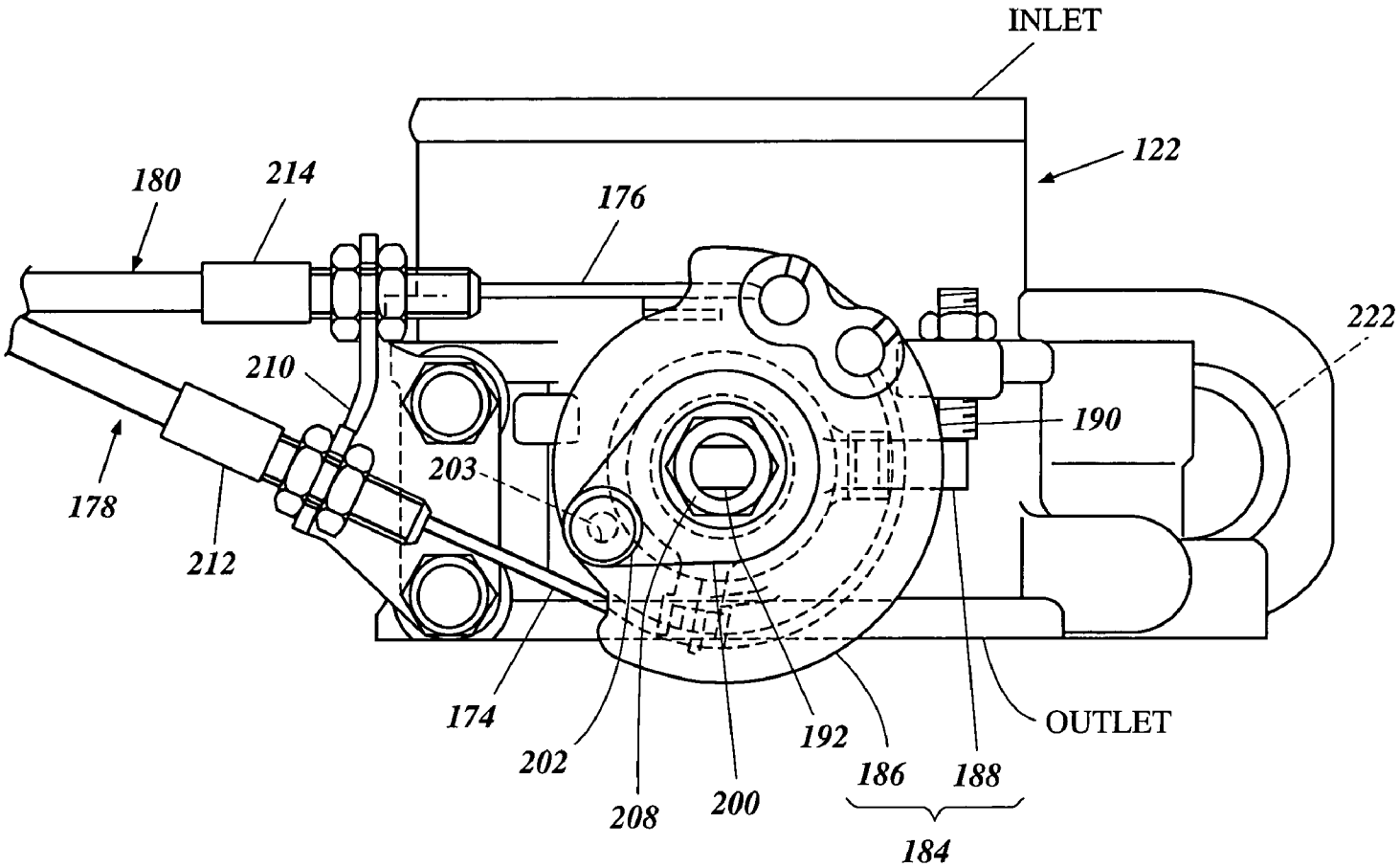
FIG. 6 is a front side elevational view of the throttling device illustrated in FIG. 5 with the throttling device illustrated in a closed position.

The pulley assembly 184 includes a main pulley 186 and a stopper lever assembly 188. The main pulley 186 includes a groove for receiving the cables 174, 176, as is known in the art. The stopper lever 188 extends from the main pulley 188 to provide reference for the fully closed position of the throttle valve 126. For example, as shown in FIG. 6, the stop lever 188, when the throttle valve 126 is in its closed position, abuts against an idle adjustment screw 190. The position of the idle adjustment screw 190 can be adjusted to adjust the fully closed door idle position of the throttle valve 126, and thereby allows for adjustment of the idle speed of the engine 24. A coil spring 189 biases the pulley 186 toward the closed position, so as to urge the lever 188 toward the idle adjustment screw 190.

With reference again to FIG. 5, the throttle valve shaft 128 includes a forward end 192 extending through a forward side of the induction passage 124. Additionally, the throttle valve shaft 128 includes a rearward end 194 extending through a rearward side of the induction passage 124. A forward side bearing 196 and a rearward side bearing 198 rotatably journal the throttle valve shaft 128 for rotation relative to the induction passage 124.

The main pulley 186 defines a central aperture through which the forward end 192 extends. The central aperture of the main pulley 186 is sized such that the pulley 186 can rotate freely relative to the throttle valve shaft 128 and relative to the throttle body 122.

The mechanical control section 182 also includes a connector member 200. The connector member 200 includes a central aperture for receiving the forward end 192 of the throttle valve shaft 128 and a connector portion 202 configured to be releasably connectable with a connector portion 204 of the main pulley 186. In the illustrated embodiment, the connector portion 204 includes an aperture alignable with an aperture 203 in the main pulley 186. As such, a bolt 206 can be inserted through the connector member 200 and into the aperture 203 so as to connect the connector portion 202 with the connector portion 204. Thus, the main pulley 186 and the connector member 200 can be rotatably fixed together. Of course, any type of connector or fastener can be used to connect the connector member 200 to the main pulley 186.

The connector member 200 is configured to be rotatably fixed to the throttle shaft 128. In the illustrated embodiment, the connector member 200 is pressed against a shoulder of the throttle valve shaft 128 with a bolt 208.

Optionally, with reference to FIG. 6, the forward end 192 of the throttle valve shaft 128 can include a flattened portion and central aperture of the connector plate 200 can be configured to cooperate with the flattened portions of the forward end 192 so as to provide a secure rotational engagement of the connector member 200 to the forward end 192.

FIG. 6 also illustrates a bracket 210 mounted to the throttle body 122 and configured to support adjustment mechanisms 212, 214 for adjusting a tension in the cables 174, 176, in a known manner.

Figure 7:
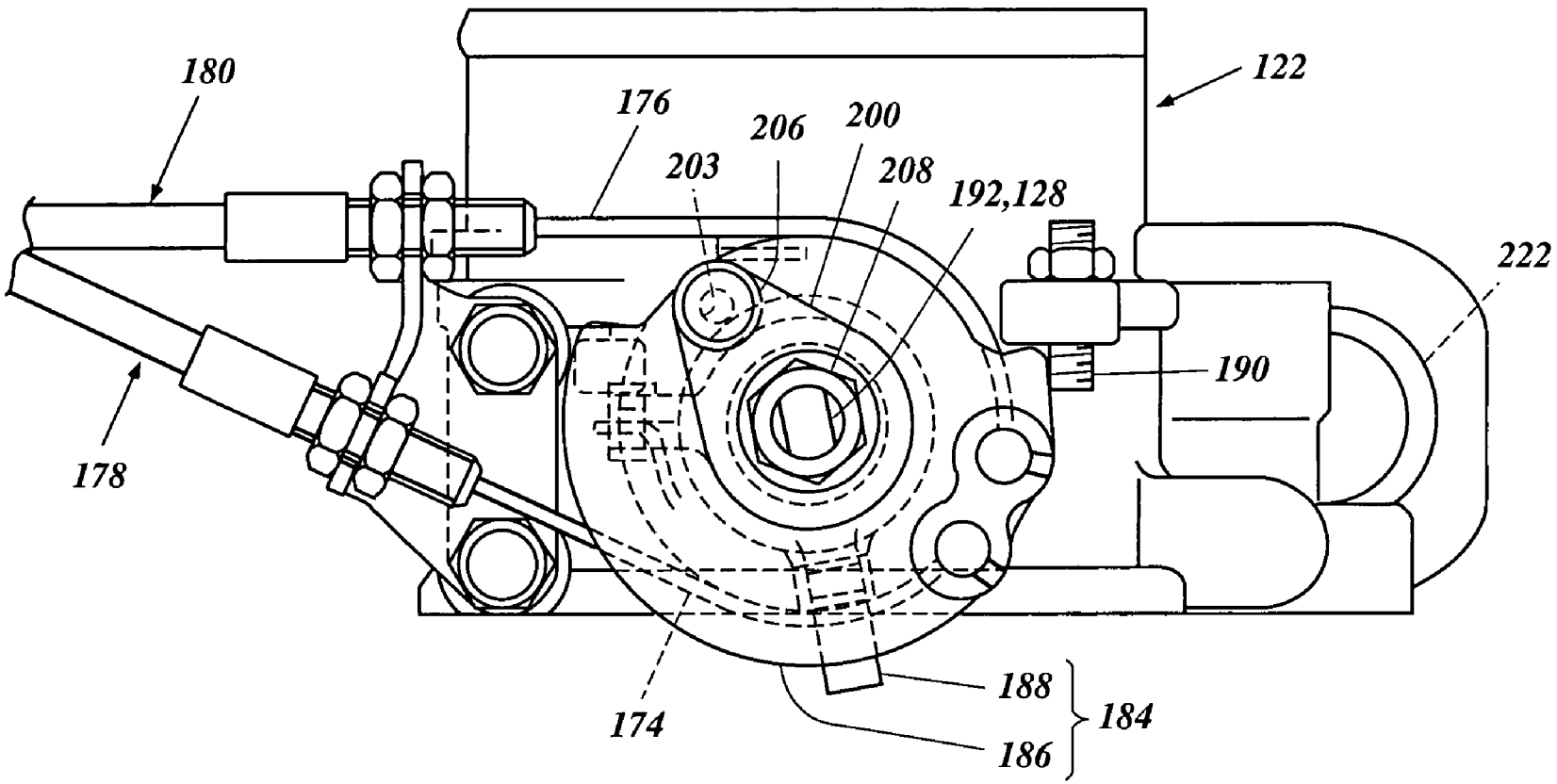
FIG. 7 is a front side elevational view of the throttling device illustrated in FIG. 6 in an open position.

With the connector member 200 rotatably engaged with the main pulley 186, the throttle valve shaft 128 will rotate with rotation of the main pulley 186. For example, as shown in FIG. 7, the main pulley 186 is illustrated in a position in which the cable 174 has been pulled by the control section 160 (FIG. 4), thereby causing the main pulley 186 to rotate in a clockwise direction (as viewed in FIG. 7) which, in turn, causes the throttle valve shaft 128 to rotate in the same direction and thereby open the throttle valve 126.

Figure 8:
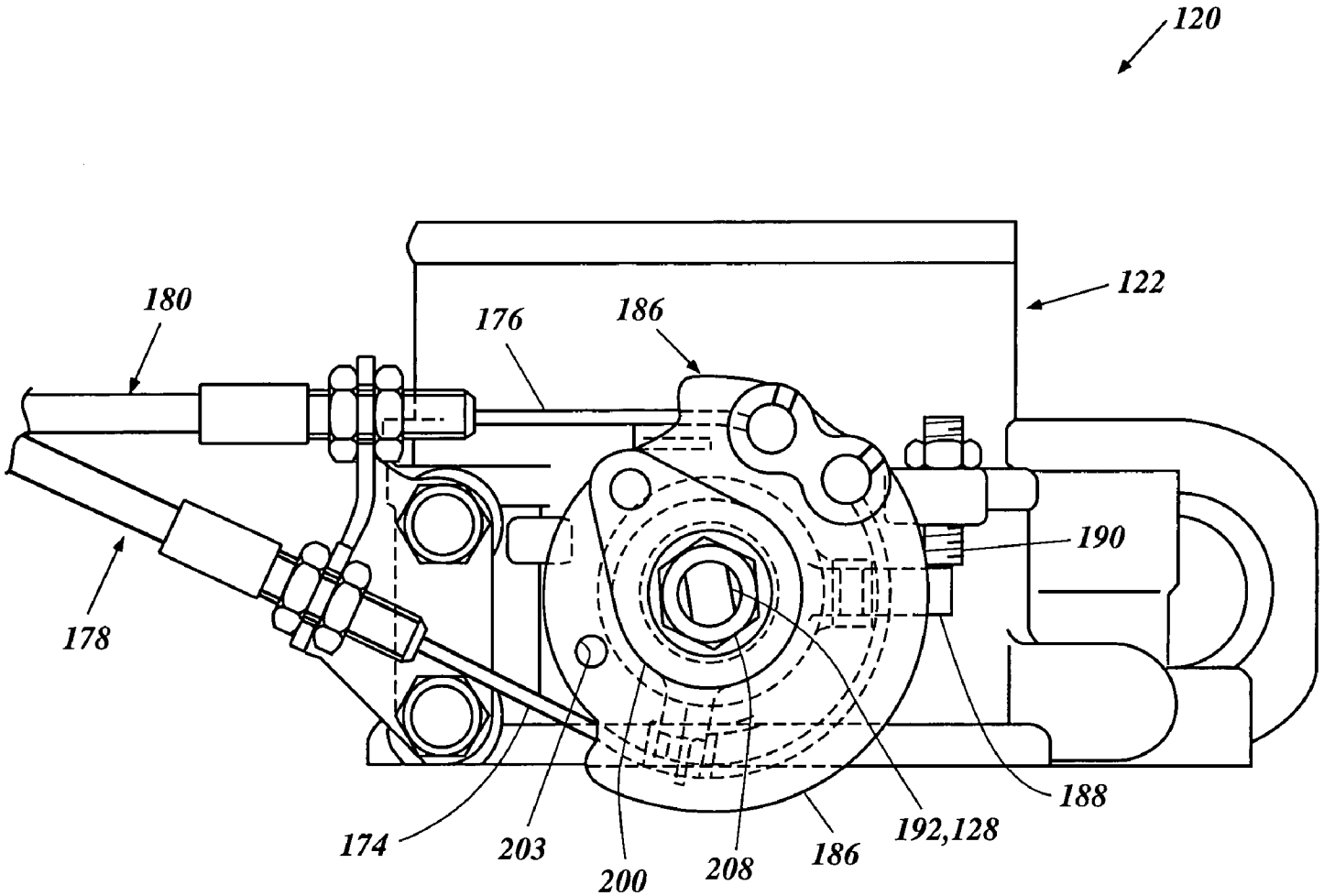
FIG. 8 is a front side elevational view of the throttling device illustrated in FIG. 6, wherein a mechanical connection to a throttle control device has been disconnected.

FIG. 8 illustrates a situation where the bolt 206 has been removed from the connector portions 202, 204 so as to allow the connector member 200, and thus the throttle valve shaft 128, to rotate freely relative to the main pulley 186. This provides a further advantage in that the throttling device 120 can be quickly changed between two modes of operation, i.e., a mode in which the position of the throttle valve 126 can be controlled by mechanical manipulation of the cables 174, 176, and a second mode of operation in which the throttle valve shaft 128 can be moved regardless of the manipulation of the cables 174, 176 and/or the position of the main pulley 186. In this second mode, the mechanical control section 182 provides little or no resistance to the rotation of the throttle valve shaft 128.

With reference again to FIG. 5, a further advantage is provided where the throttling device 120 is configured to allow control inputs from another control system. In the illustrated embodiment, the throttling device 120 is configured to receive throttle control inputs from an electronic throttle control system 220. The electronic throttle control 220 includes an electric motor 222 that is configured to rotate the throttle valve shaft 128 relative to the throttle body 122.

Figure 9:
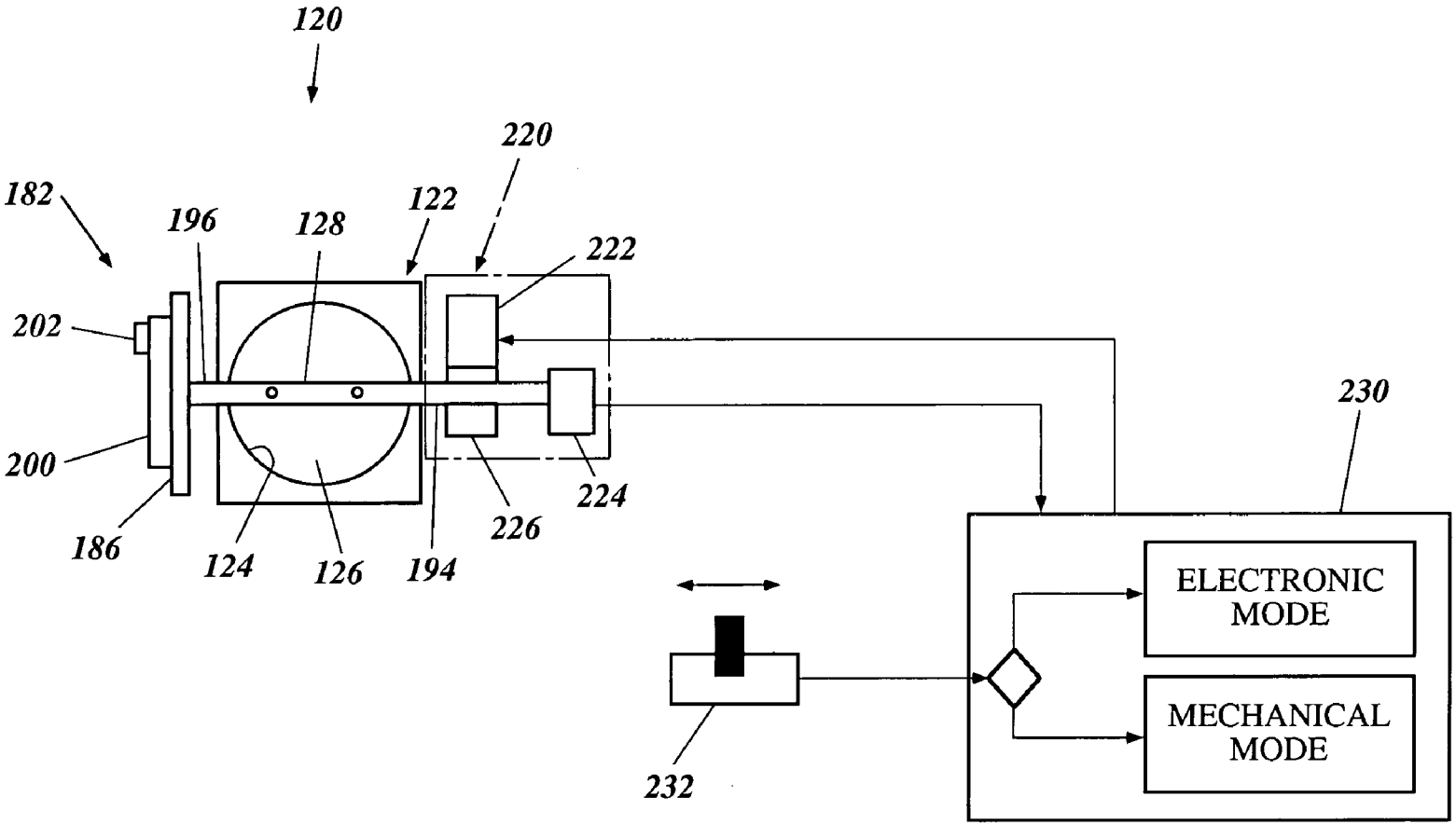
FIG. 9 is a schematic illustration of the throttling device illustrated in FIG. 6 and electronic connections to an electronic throttle control device.

FIG. 9 includes a schematic illustration of the throttling device 120, the mechanical input section 182, and the electronic control section 220. As shown in FIG. 9, the electronic control portion 220 includes a throttle position sensor 224 configured to detect a position of the throttle valve 126. In the illustrated embodiment, the throttle valve position sensor 224 is configured to detect a rotational position of the throttle shaft 128 which corresponds to an opening degree of the throttle valve 126.

Optionally, the control section 220 can include a connector module 226 for providing selective engagement of the motor 222 with the throttle valve shaft 128. In the illustrated embodiment, the connector module 226 is a clutch mechanism configured to allow the motor 222 to be selectively engaged and disengaged from the throttle valve shaft 128. In the illustrated embodiment, the motor 222 is arranged such that its output shaft extends parallel to the throttle valve shaft 128. The clutch mechanism 226 is interposed between the output shaft of the motor 222 and the throttle valve shaft 128 to allow select engagement and disengagement therebetween.

With continued reference to FIG. 9, an electronic control unit 230 is connected to the motor 222 so as to provide an output signal for driving the motor 222. Additionally, electronic control unit 230 is connected to the throttle position sensor 224 so as to receive position data from the sensor 224 regarding the position of the throttle valve 126. As noted above, the electronic control unit 230 can be configured to control numerous functions of the outboard motor 10, including, for example, but without limitation, control of the fuel injection and ignition systems. In the illustrated embodiment, the electronic control unit 230 is also configured to provide at least two modes of operation. FIG. 9 schematically illustrates two modes of operation as the electronic mode and the mechanical mode.

When operating in the mechanical mode, the electronic control unit 230 allows the throttle valve shaft 128 to be moved in accordance with the operation of the mechanical control section 182 of the throttling device 120. In this mode, the electronic control unit 230 can use the output of the throttle position sensor 224 to control the operation of any desired engine function, including, for example, but without limitation, the fuel injection and ignition systems. In this mode, the ECU 230 can also control the clutch mechanism 226 to disengage the electric motor 222 from the throttle valve shaft 128.

Optionally, the mechanical mode can include a selective operation of the motor 222 so as to provide an idle speed control function. For example, the ECU 230 can control the electric motor 222 to provide for a smooth or consistent idle speed of the engine 24. As such, the ECU 230 can adjust the position of the throttle valve 126, when the operator has placed the throttle control lever in the watercraft 12 in an idle position so as to increase the opening of the throttle valve 126 when an accessory is used which would otherwise slow down the engine 24. Further, the ECU 230 can be configured to, for example, but without limitation, use the electric motor 222 as a cruise control mechanism.

The ECU 230 can be configured to, when in the electronic mode, operate the electric motor 222 to control the opening of the throttle valve 126 at all times during operation of the outboard motor 10. For example, the ECU 230 can be connected to an electronic "throttle lever" in the watercraft 10 and configured to drive the electric motor 222 so as to provide a power output from the engine 24 in accordance with the position of the throttle lever in the watercraft 12. In this mode, the speed of movement and the target opening of the throttle valve 126 can be optimized using known control parameters and, for example, but without limitation, maps stored as data within the ECU 230 to provide optimal torque, efficiency and/or emissions control.

The outboard motor 10 also includes a selector 232 configured to allow the ECU 230 to be switched between the electronic mode and the mechanical mode. For example, the selector 232 can be disposed anywhere within the watercraft 12, or the outboard motor 10. The selector 232 can include a manually operable switch having at least two positions, one corresponding to the electronic mode and one corresponding to the mechanical mode.

As such, the engine 24 can be easily switched between a mechanical throttle operation mode and an electronic throttle operation mode. For example, to operate the engine 24 in the mechanical throttle operation mode, the selector 232 is moved to the mechanical mode position and the bolt 202 is inserted through the connector member 200 and into the main pulley 186 to thereby engage the mechanical control section 182 to the throttle valve shaft 128. As such, the ECU 230 can disengage the clutch mechanism 226 and allow the throttle valve shaft 128 to be moved solely by the mechanical control section 182. As noted above, optionally, the ECU 230 can control the clutch mechanism 226 to allow the electric motor 222 to be used as an idle speed or a cruise controller.

When operated in the electronic throttle control mode, the selector 232 is moved to the electronic throttle control mode position and the bolt 202 is removed. Thus, regardless of the movement of the main pulley 186, the throttle valve shaft 128 can be controlled by the motor 222.

Constructed as such, the outboard motor 10 can be fully assembled and delivered to outboard motor dealerships as being compatible with watercraft that have electronic throttle lever systems and watercraft that use only mechanical throttle lever control equipment. Where the outboard motor 10 is connected to a watercraft having electronic throttle control equipment, the mechanical input system 160 is not used. However, the components of the system 160 are mass-produced and are not excessively heavy. Thus, including the components of the system 160 where they are not used for throttle control operation, does not add excessive weight or cost to the outboard motor 10. Additionally, where the outboard motor 10 is used in the mechanical mode, the same electric motor 222 can be used as an idle speed and/or a cruise controller. Thus, the motor 222 is not completely unused. As such, greater efficiencies of scale can be realized by using one motor, e.g., the motor 222, to satisfy two different parts of an outboard motor market.

With reference again to FIG. 4, as noted above, the throttle valve shaft 128 extends generally horizontally in a forward-rearward direction. Additionally, the throttling device 120 is disposed at a forward end of the outboard motor 10 with the mechanical input section 182 disposed on a forward side of the throttling device 120. This provides a further advantage in that the bolt 202 can be accessed immediately by removing the cowling 20. As such the mechanical input section 182 can be quickly and conveniently engaged or disengaged from the throttle valve shaft 128.

Figure 10:
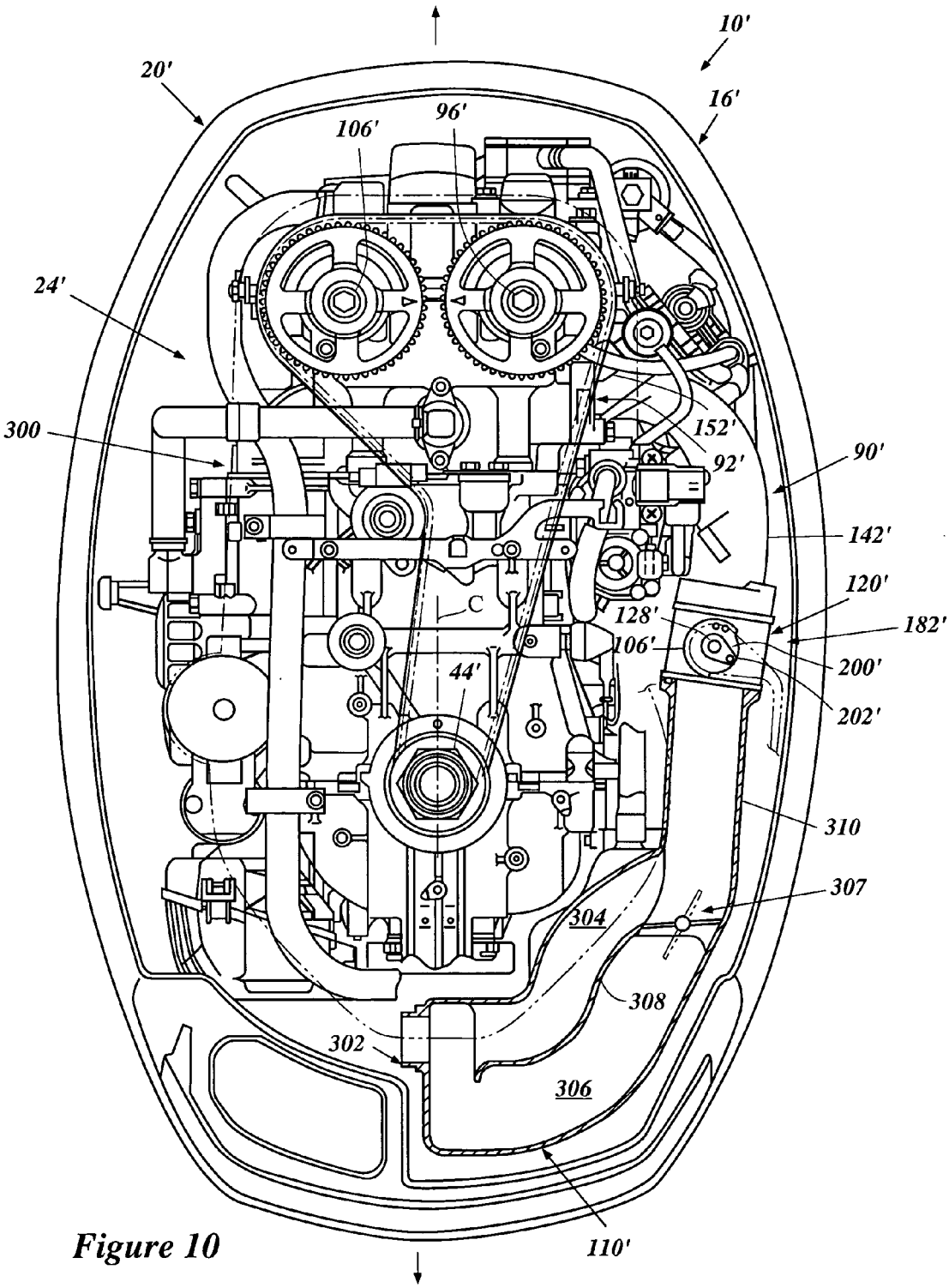
FIG. 10 is a top plan and partial sectional view of another engine configured in accordance with one of the embodiments disclosed herein.

With reference to FIG. 10, another embodiment of the outboard motor 10 is illustrated therein, identified generally by the reference numeral 10'. The outboard motor 10' is described below using the same reference numeral for components corresponding to the outboard motor 10, except that a "'" has been added thereto.

The outboard motor 10' includes an engine 24' which is an in-line, four-stroke multi-cylinder, water-cooled engine. Thus, the induction system 90' is disposed on one side of the center plane C and the exhaust system 300 is disposed on the other side of the center plane C.

The engine 24' is also a dual overhead cam engine, like the engine 24, and includes intake and exhaust cam shafts 96', 106' that operate in accordance with the description set forth above with respect to the cam shafts 96 and 106. As illustrated in FIG. 10, the crankshaft 44' is disposed vertically within the powerhead 16'.

The induction system 90' of the outboard motor 10' includes a first plenum chamber 110' that includes a single inlet 302 which opens into the interior of the powerhead 16. The plenum chamber 110' is divided into a primary induction path 304 and a secondary induction path 306. A wall 308 extends between the primary and secondary passages 304, 306.

A valve 307 is disposed at a downstream end of the secondary passages 306. The valve 307 can be electronically controlled to adjust certain characteristics of the airflow through the induction system 90'. For example, the valve 307 can be closed during low speed operation, thereby guiding induction air into the passage 310 only through the primary passage 304, thus promoting higher air speed and other characteristics. At higher speed operation, the valve 307 can be opened to allow a freer flow of air into the passage 310. Of course, other known control strategies can be used for the control of the valve 307.

The primary and second passages 304, 306 merge into a common passage 310. At a downstream end, the passage 310 is connected to a throttling device 120'. At the downstream end of the throttling device 120', an intake runner 142' connects the throttling device 120' to an intake port 92'. A fuel injector 152' is configured for port-type fuel injection.

The induction system 90' of the outboard motor 10' can include one plenum chamber 110', one induction passage 310, one throttling device 120', and one intake runner 142' for each cylinder of the engine 24', so that each cylinder has a distinct induction air flow path. Alternatively, certain components of the induction system 90' can form common chambers for feeding all the cylinders and then be bifurcated to guide air into each individual cylinder.

With continued reference to FIG. 10, the uppermost throttling device 120' includes a mechanical control section 182' that can be constructed in accordance with the description of the mechanical control section 182 illustrated in FIG. 5. With this arrangement, the throttle shaft 128 can extend downward through all of the throttling devices 120', to form a common throttle valve shaft. Thus, the mechanical control section 182' of the uppermost throttling device 120' can be used to control the movements of the throttle valves of all the throttling devices 120', when operated in the mechanical mode. The electronic control section (not shown) corresponding to the electronic control section 220 described above with reference to FIG. 9, can be disposed on a lower side of the uppermost throttling device 120' or adjacent to any of the other throttling devices 120' disposed below the uppermost throttling device 120'. Of course, the electronic control section 220 could be disposed on the same side as the mechanical control section 182, 182'. However, the construction and assembly of the electronic control sections 220 and the mechanical control sections 182, 182' is further simplified if these sections are disposed on opposite sides of the corresponding throttling device 120, 120'.

With the mechanical control section 182' disposed as such, the bolt 202' can easily and quickly be accessed after removing the upper cowling 20', thereby allowing the outboard motor 10' to be switched between an electronic throttle control mode and a mechanical throttle control mode.

Figure 11:
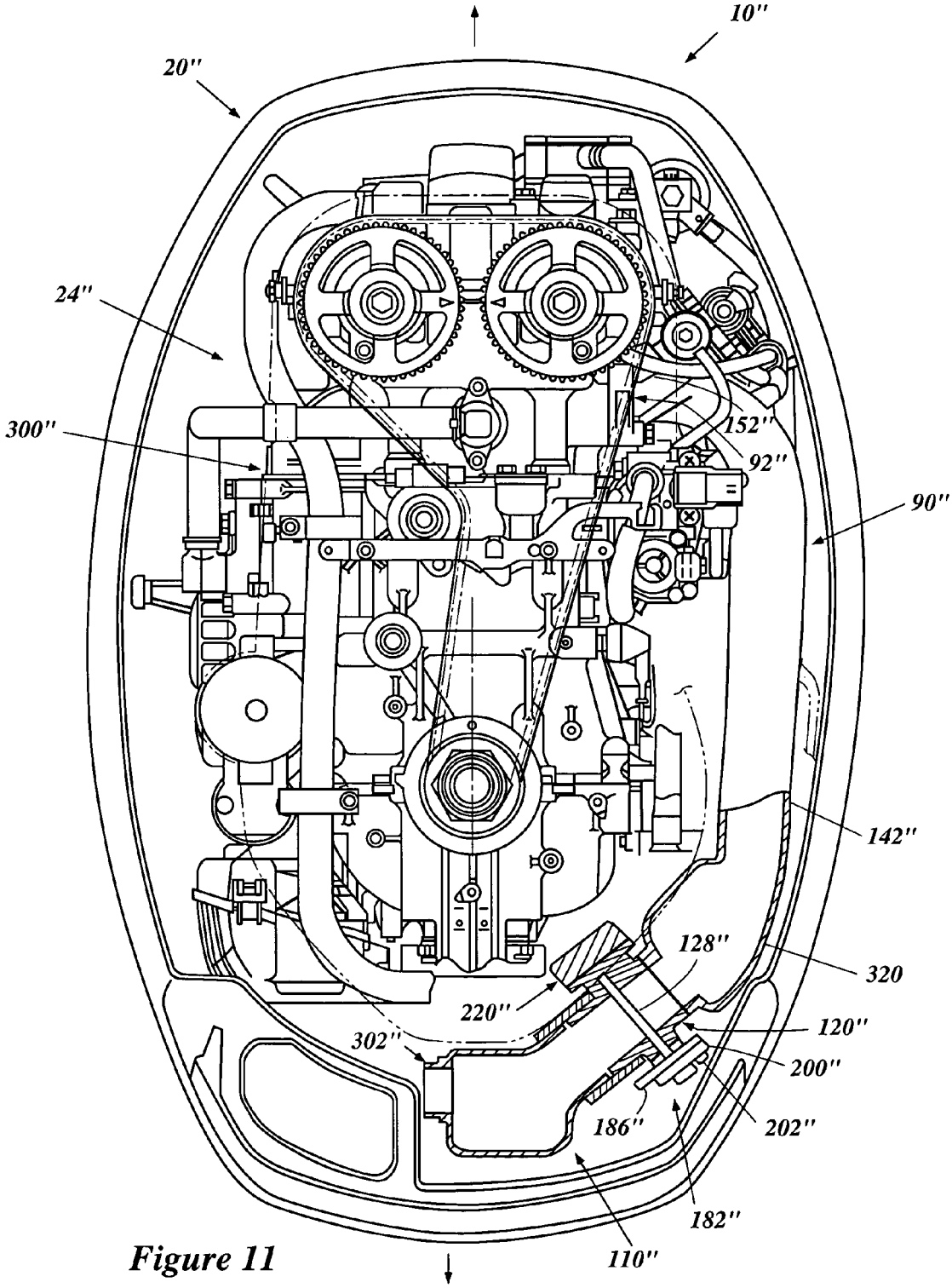
FIG. 11 is a top plan and partial sectional view of an engine constructed in accordance with at least one of the embodiments disclosed herein.

With reference to FIG. 11, another embodiment of the outboard motor 10 is illustrated therein and identified generally by the reference numeral 10". Components of the outboard motor 10" that are the same or similar to the outboard motors 10 or 10' are identified using the same reference numerals except that a "" has been added thereto.

The outboard motor 10" is generally the same as the outboard motor 10', except for the layout of the induction system 90" and the orientation of the throttling device 120".

The induction system 90" includes a single inlet plenum chamber 110 having an inlet 302". Additionally, the induction system 90" includes a single throttling device 120" having an inlet end connected to the plenum chamber 110" and an outlet end connected to a surge chamber 320. A plurality of individual intake runners 142" branch off of the surge chamber 320 and extend to corresponding intake ports 92".

In the illustrated embodiment, the throttle valve shaft 128" extends generally horizontally within the outboard motor 10". The mechanical control section 182" is disposed on an outward end of the throttle valve shaft 128'. Additionally, the electronic control section 220" is disposed at an inner end of the throttle valve shaft 128". As used herein the term "inner end" refers to the end of the throttle valve shaft 128' that extends toward the engine 24". The term "outward end" refers to the end of the throttle valve shaft 128' that extends away from the engine 24".

Positioned as such, the bolt 202" which connects the main pulley 186" and the connector member 200" can be easily accessed after removal of the upper cowling 20".

Although this invention has been described in terms of certain preferred embodiments, other embodiments apparent to those of ordinary skill in the art are also within the scope of these inventions. Accordingly, the scope of the present inventions should be defined only by the appended claims.

What is claimed is:

1. An engine comprising an engine body defining a combustion chamber therein, an induction system configured to guide air to the combustion chamber, an air metering device configured to meter an amount of air flowing through the induction system toward the engine body, the air metering device including a mechanical interface connectable to a mechanical power output request device so as to allow the air metering device to be adjusted mechanically between its maximum and minimum operating conditions, an electronic actuator capable of adjusting the air metering device between its maximum and minimum operating conditions, a switch configured to selectively enable and disable the electronic actuator from operating the air metering device between its maximum and minimum operating conditions, and a controller configured to operate in at least first and second modes, the controller being configured to disengage the actuator from the metering device, in the first mode, when the engine is operating at a speed above idle speed.

2. The engine according to claim 1, wherein the mechanical interface and the electronic actuator are disposed on opposite sides of the air metering device.

3. The engine according to claim 1, wherein the air metering device comprises a throttle valve disposed on a throttle shaft.

4. The engine according to claim 3 additionally comprising a connector member rotatably connected to the throttle valve shaft, wherein the mechanical interface includes a central aperture through which the throttle shaft extends, the aperture being sized such that the throttle shaft can rotate freely within the aperture.

5. The engine according to claim 4 additionally comprising a removable fastener connecting the connector member to the mechanical interface.

6. The engine according to claim 5, wherein the mechanical interface is a throttle cable pulley.

7. The engine according to claim 1, wherein the controller is configured to adjust the air metering device between its maximum and minimum positions in proportion to a position of the power output request device when in the second mode.

8. The engine according to claim 1, in combination with an outboard motor.

9. The engine according to claim 1, wherein mechanical interface is disposed on a side of the air metering device facing away from the engine body.

10. An engine comprising an engine body defining a combustion chamber therein, an induction system configured to guide air to the combustion chamber, an air metering device configured to meter an amount of air flowing through the induction system toward the engine body, the air metering device including a mechanical interface and an electronic actuator, each of which are configured to adjust the air metering device between its maximum and minimum operating conditions, and means for selectively disengaging the mechanical interface and the electronic actuator from the air metering device, the means for selectively disengaging comprising a controller configured to operate in at least first and second modes, the controller being configured to disengage the actuator from the metering device, in the first mode, when the engine is operating at a speed above idle speed.

11. The engine according to claim 9, wherein the air metering device comprises a throttle valve shaft, the mechanical interface and the electronic actuator being selectively disengageable from the throttle valve shaft.

12. The engine according to claim 1, wherein the switch is configured to provide an indication whether or not the mechanical interface is operatively connected to the air metering device.

* * * * *

UNITED STATES PATENT AND TRADEMARK OFFICE

CERTIFICATE OF CORRECTION

PATENT NO. : 7,185,630 B2
APPLICATION NO. : 10/714759
DATED : March 6, 2007
INVENTOR(S) : Masanori Takahashi et al.

It is certified that error appears in the above-identified patent and that said Letters Patent is hereby corrected as shown below:

At column 11, line 4, after "position" insert -- , --.

At column 13, line 44, after "herein" insert -- , --.

At column 14, line 55, in claim 11, delete "9," and insert -- 10, --, therefore.

Signed and Sealed this

Eleventh Day of December, 2007

JON W. DUDAS
*Director of the United States Patent and Trademark Office*